US011469552B2

(12) United States Patent
Kim et al.

(10) Patent No.: US 11,469,552 B2
(45) Date of Patent: Oct. 11, 2022

(54) PLUG CONNECTOR SLIDABLY INSERTED INTO RECEPTACLE CONNECTOR

(71) Applicant: SENSORVIEW CO., LTD., Gyeonggi-do (KR)

(72) Inventors: Byoung Nam Kim, Gyeonggi-do (KR); Kyoung Il Kang, Gyeonggi-do (KR); Joung Min Park, Gyeonggi-do (KR); Sung Cheol Cho, Incheon (KR); Jong Hyup Lim, Gyeonggi-do (KR)

(73) Assignee: SENSORVIEW CO., LTD., Gyeonggi-do (KR)

( * ) Notice: Subject to any disclaimer, the term of this patent is extended or adjusted under 35 U.S.C. 154(b) by 0 days.

(21) Appl. No.: 17/318,082

(22) Filed: May 12, 2021

(65) Prior Publication Data

US 2021/0367382 A1 Nov. 25, 2021

(30) Foreign Application Priority Data

May 25, 2020 (KR) ..... 10-2020-0062338

(51) Int. Cl.

| | |
|---|---|
| ***H01R 13/6585*** | (2011.01) |
| ***H01R 12/75*** | (2011.01) |
| ***H01R 24/62*** | (2011.01) |
| ***H01R 13/6581*** | (2011.01) |
| *H01R 24/64* | (2011.01) |
| *H01R 13/6589* | (2011.01) |

(Continued)

(52) U.S. Cl.

CPC ..... *H01R 13/6585* (2013.01); *H01R 12/75* (2013.01); *H01R 13/6581* (2013.01); *H01R 24/62* (2013.01); *H01R 13/502* (2013.01); *H01R 13/6589* (2013.01); *H01R 24/64* (2013.01); *H01R 2103/00* (2013.01)

(58) Field of Classification Search

CPC ..... H01R 13/6585; H01R 12/75; H01R 13/6581; H01R 24/62; H01R 13/502; H01R 13/6589; H01R 24/64; H01R 2103/00

See application file for complete search history.

(56) References Cited

U.S. PATENT DOCUMENTS

| | | | | |
|---|---|---|---|---|
| 8,641,450 | B2 * | 2/2014 | Li | H01R 13/6586 439/540.1 |
| 8,851,931 | B2 * | 10/2014 | Pan | H01R 27/00 439/607.49 |
| 2006/0228952 | A1 * | 10/2006 | Feldman | H01R 4/024 439/835 |

FOREIGN PATENT DOCUMENTS

| | | | |
|---|---|---|---|
| JP | 2018063795 | A | 4/2018 |
| WO | WO-2019136199 | A2 | 7/2019 |

OTHER PUBLICATIONS

Office Action from corresponding Korean Patent Application No. 10-2020-0062338 dated Aug. 11, 2021.

* cited by examiner

*Primary Examiner* — Abdullah A Riyami
*Assistant Examiner* — Justin M Kratt
(74) *Attorney, Agent, or Firm* — Harness, Dickey & Pierce, P.L.C.

(57) ABSTRACT

A plug connector according to the present invention is slidably inserted into a receptacle connector, and includes a signal pin having one side in electrical contact with one side of a signal line of a cable; a shield can electrically spaced apart from the signal pin and surrounding the signal pin such that a lower surface of the other side of the signal pin is exposed; a first insulating member coupled to the signal pin to insulate the signal pin and the shield can from each other; and a plug shell surrounding the shield can such that the lower surface of the other side of the signal pin is exposed.

7 Claims, 21 Drawing Sheets

(51) Int. Cl.

| | |
|---|---|
| *H01R 13/502* | (2006.01) |
| *H01R 103/00* | (2006.01) |

PLUG CONNECTOR SLIDABLY INSERTED INTO RECEPTACLE CONNECTOR

CROSS-REFERENCE TO RELATED APPLICATION

This application claims the benefit under 35 USC § 119(a) of Korean Patent Application No. 10-2020-0062338, filed on May 25, 2020, in the Korean Intellectual Property Office, the entire disclosure of which is incorporated herein by reference for all purposes.

FIELD

The following description relates to a connector, and more particularly, to a plug connector that is slidably inserted into a receptacle connector.

BACKGROUND

In various types of electronic devices (e.g., wired/wireless communication devices, etc.), internal circuits are implemented on circuit boards. A connector assembly including a receptacle connector and a plug connector is used to connect the circuit board to another electronic device or another circuit board. The receptacle connector is mounted on the circuit board, the plug connector is coupled to a cable, and the plug connector is coupled to the receptacle connector, so that the cable and the circuit board are electrically connected.

Conventional connector assemblies have a structure in which a plug connector is vertically fastened to a receptacle connector with respect to a circuit board. Accordingly, it is difficult to miniaturize the connector assembly due to the height of the connector assembly and fastening copper wires of the plug connector, and such a structure is unfavorable in shielding electromagnetic waves. Also, it is difficult to simultaneously connect a plurality of cables and a circuit board with a single connector assembly.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An objective of the present invention is to provide a structure in which a plug connector is slidably inserted into a receptacle connector, which is favorable for miniaturization of a connector assembly by allowing the height of the connector assembly to be reduced and making a fastening copper wire of the plug connector parallel to a circuit board.

In addition, another objective of the present invention is to provide a plug connector which provides excellent electromagnetic wave shielding performance and is capable of simultaneously connecting a plurality of cables and a circuit board.

The objectives to be achieved by the present invention are not limited to the foregoing objectives, and additional objectives, which are not mentioned herein, will be readily understood by those skilled in the art from the following description.

In one general aspect of the present invention, a plug connector that is slidably inserted into a receptacle connector includes: a signal pin having one side in electrical contact with one side of a signal line of a cable; a shield can electrically spaced apart from the signal pin and surrounding the signal pin such that a lower surface of the other side of the signal pin is exposed; a first insulating member coupled to the signal pin to insulate the signal pin and the shield can from each other; and a plug shell surrounding the shield can such that the lower surface of the other side of the signal pin is exposed.

The shield can may include a lower shield can having a seating groove in which a lower portion of the cable is seated and an upper shield can having a seating groove in which an upper portion of the cable is seated and covering the lower shield can.

A plurality of signal pins may be arranged in parallel to each other corresponding to a plurality of cables, and the shield can may include a shielding wall that shields between adjacent signal pins.

The signal pin may include a first portion on one side thereof which has an insertion portion into which the signal line is inserted and a second portion on the other side thereof which is formed integrally with the first portion and has the lower surface of the other side.

The first insulating member may have a through hole through which the second portion of the signal pin passes, and may include a first section that forms an upper portion of the through hole and is formed to expose the lower surface of the other side of the second portion while covering an upper portion of the second portion; and a second section that forms a lower portion of the through hole and is formed below the first section to be shorter than the first section such that the lower surface of the other side of the second portion is exposed.

The shield can may include: a lower shield can having a seating groove in which a lower portion of the cable is seated and a seating groove in which the second section of the first insulating member is seated; and an upper shield can covering the lower shield can and having a seating groove in which an upper portion of the cable is seated and a seating groove in which the first section of the first insulating member is seated.

The plug shell may be formed of a metal material.

The plug shell may have an enclosing portion that encloses and supports a portion of the cable exposed to the outside of the shield can.

Other features and aspects will be apparent from the following detailed description, the drawings, and the claims.

Figure 1A:
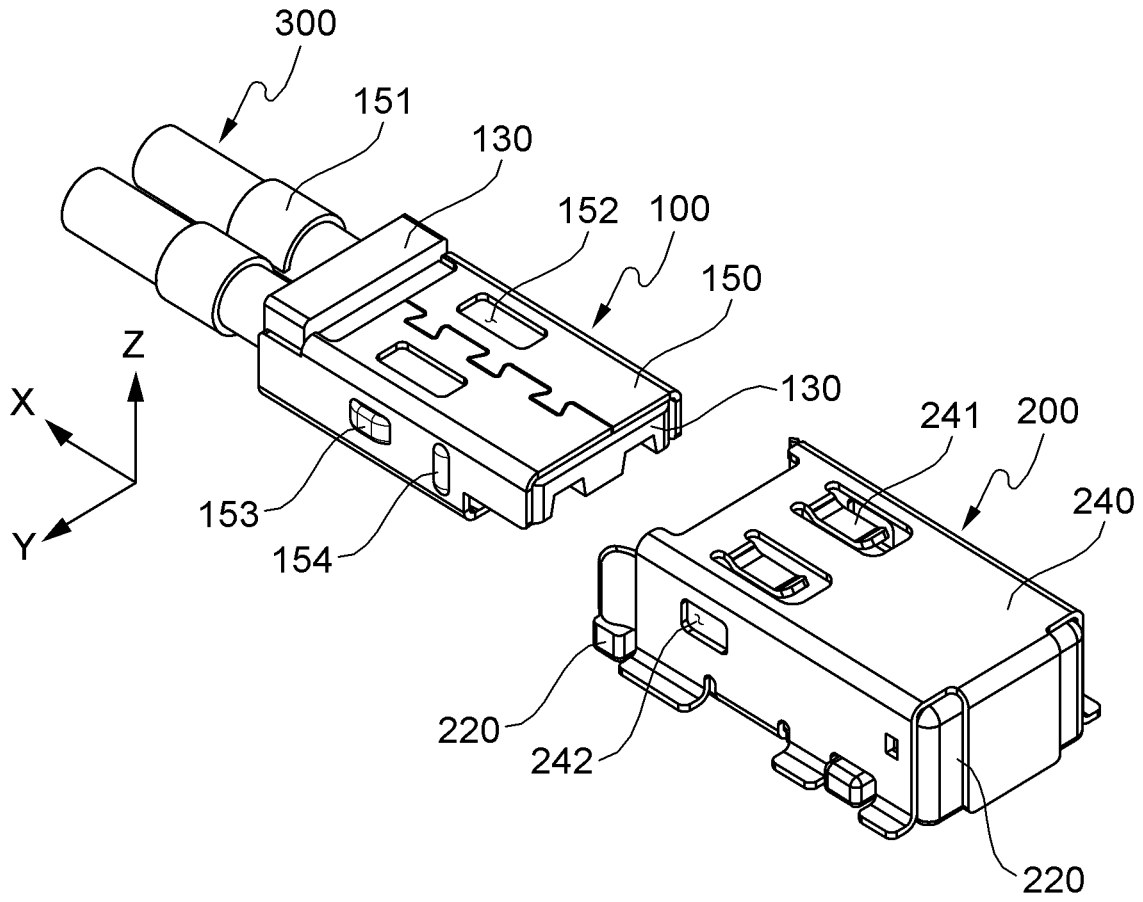
FIG. 1A is a perspective view of a connector assembly according to an embodiment of the present invention, when viewed from one side.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1B:
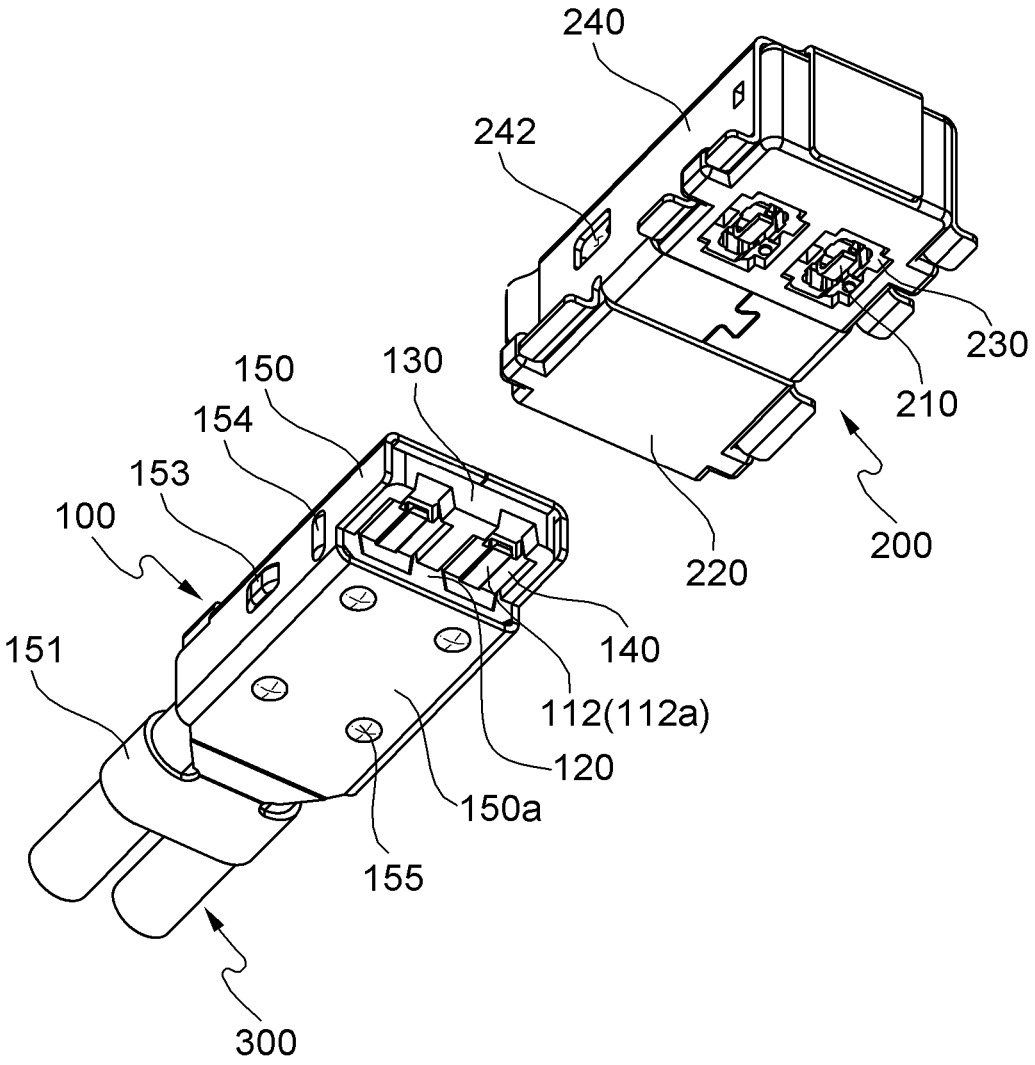
FIG. 1B is a perspective view of the connector assembly shown in FIG. 1A, when viewed from another side.
Figure 1C:
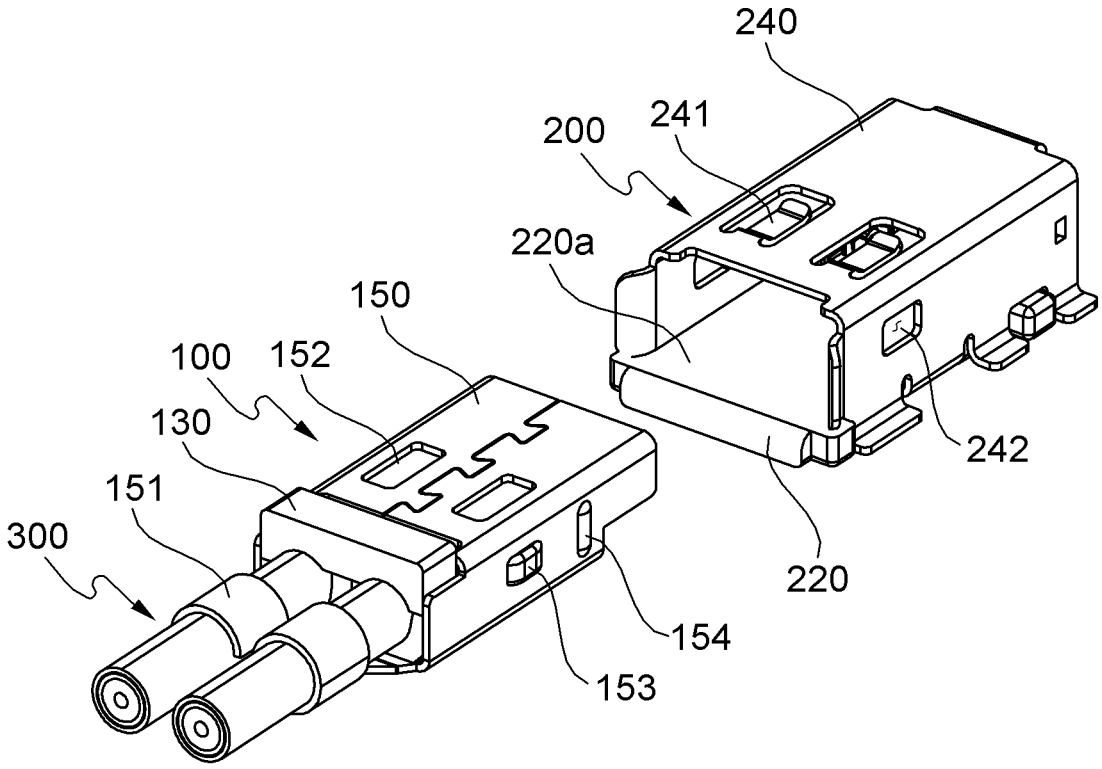
FIG. 1C is a perspective view of the connector assembly shown in FIG. 1A, when viewed from still another side.

FIGS. 1A to 1C are views of a connector assembly according to an embodiment of the present invention. In this specification, for convenience of description, with respect to FIG. 1A, the positive X-axis direction is defined as a forward direction (or a front side or a front end) and the negative X-axis direction is a rearward direction (or a rear side or a rear end). The positive Z-axis direction is defined as an upper direction (or an upper surface or an upper end) and the negative Z-axis direction is a lower direction (or a lower surface or a lower end). The positive and negative Y-axis directions are defined as a lateral direction. FIG. 1A is a perspective view of the connector assembly as viewed from the upper rear side thereof, FIG. 1B is a perspective view of the connector assembly as viewed from the lower rear side thereof, and FIG. 1C is a perspective view of the connector assembly as viewed from the upper front side thereof.

The connector assembly according to the present embodiment includes a receptacle connector 200 mounted on a circuit board (which is designated by reference P in FIG. 6C), and a plug connector 100 which is coupled to a cable 300 and slidably inserted into the receptacle connector 200.

The receptacle connector 200 may be mounted on the circuit board P using a surface mount method, such as surface mount device (SMD) or surface mount technology (SMT), a through-hole method, such as single in-line package (SIP), dual in-line package (DIP), quad in-line package (QIP), or the like, or both the surface mount method and the through-hole method. According to an embodiment, the receptacle connector 200 may not be a separate component but may be integrally formed with the circuit board P.

The receptacle connector 200 may have a shape in which the front end is open and the rear end is closed so that the plug connector 100 can be slidably inserted from the front end.

Figure 2A:
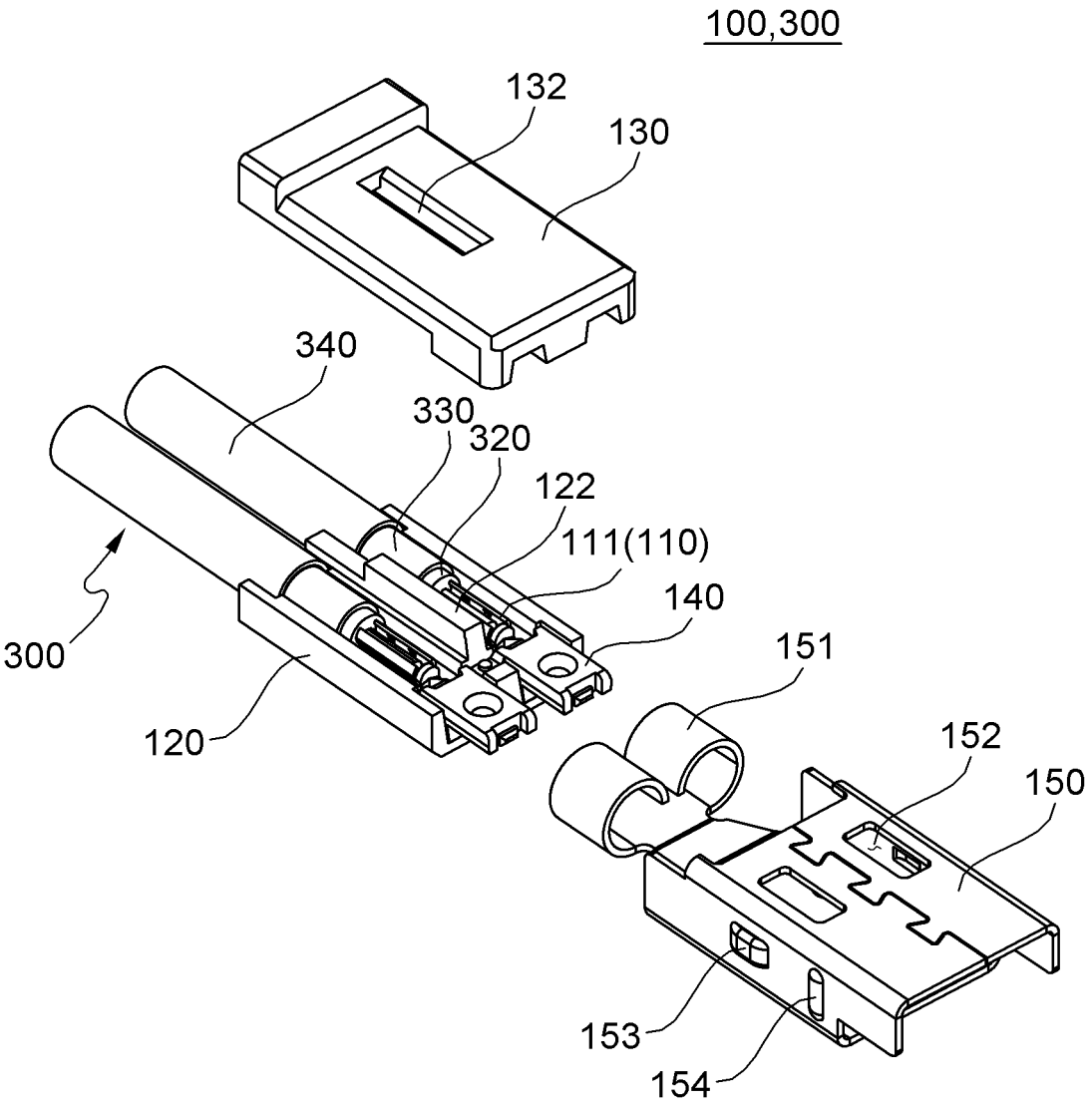
FIG. 2A is a first exploded view of a plug connector according to an embodiment of the present invention.
Figure 2B:
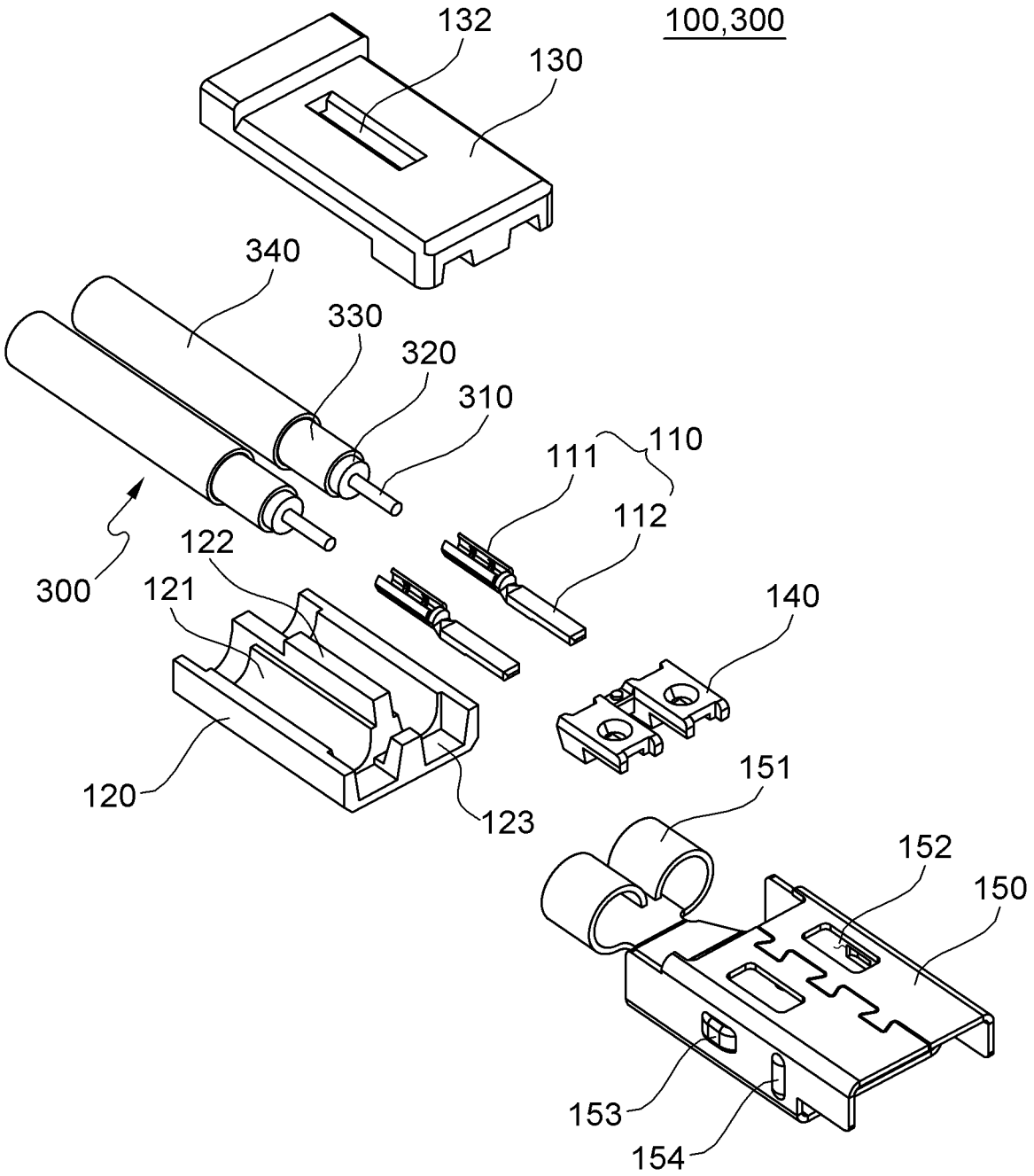
FIG. 2B is a second exploded view of a plug connector according to an embodiment of the present invention.
Figure 2C:
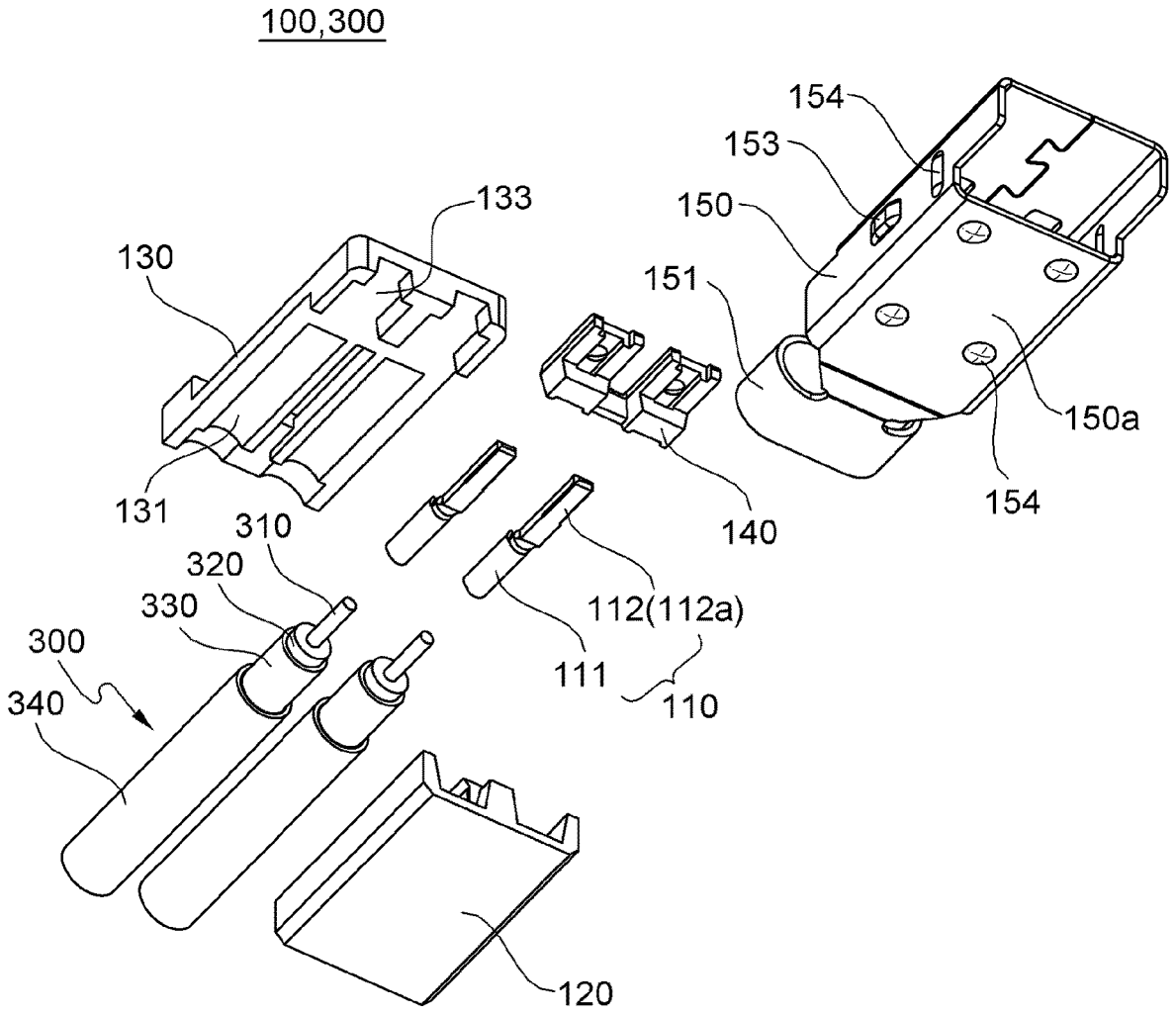
FIG. 2C is a view of the plug connector shown in FIG. 2B, when viewed from a different side.

FIGS. 2A to 2C are views of the plug connector 100 according to an embodiment of the present invention. FIG. 2A is a first exploded view of the plug connector 100 as viewed from the upper rear side thereof, FIG. 2B is a second exploded view of the plug connector 100 as viewed from the upper rear side thereof, and FIG. 2C is a view of the plug connector 100 shown in FIG. 2B, when viewed from the lower rear side.

In the present embodiment, a coaxial cable is described as an example of the cable 300 coupled to the plug connector 100, but the cable 300 may be any of various types of cables, such as a data cable, a wire, a flexible flat cable (FFC), a flexible printed circuit (FPC), and the like, instead of the coaxial cable.

The cable 300 may include a signal line (internal conductor) 310, an outer conductor 330 made of aluminum, copper, etc. which shields electromagnetic waves of the signal line 310, a dielectric material 320 that insulates and separates the signal line 310 and the outer conductor 330 from each other, and a jacket 340 that protects the outer conductor 330.

The plug connector 100 includes signal pins 110, shield cans 120 and 130, a first insulating member 140, and a plug shell 150.

In the present embodiment, two cables 300 are provided, but the number of cables 300 may be one or three or more. When there are a plurality of cables 300, the cables 300 are disposed in parallel to each other. Those skilled in the art will understand that the number or structures of the signal pins 110, the shield cans 120 and 130, the first insulating members 140, and the plug shells 150 may be appropriately modified according to the number of cables 300.

The signal pin 110 may be formed such that a front end thereof is in electrical contact with the signal line 310 of the cable 300 and a lower surface 112*a* of a rear side thereof is in elastic contact with an upper side of a clip pin 210 of the receptacle connector 200 which will be described below. The signal pin 110 is provided for each cable 300, and when there are a plurality of cables 300, a plurality of signal pins 110 are also arranged in parallel to each other.

The signal pin 110 may include a first portion 111 at the front side and a second portion 112 integrally formed at the rear side with the first portion 111. The first portion 111 may include an insertion portion into which the signal line 310 is inserted. The first portion 111 of the signal pin 110 and the signal line 310 may be in electrical contact with each other by tightening or soldering. One or more protrusions may be formed inside the first portion 111 of the signal pin 110 to improve tensile force for fixing the signal line 310. The second portion 112 has a lower surface 112*a* in elastic contact with an upper portion of the clip pin 210 of the receptacle connector 200.

The shield cans 120 and 130 surround the signal pin 110 so that the lower surface 112*a* of the second portion 112 of the signal pin 110 is exposed, and are formed to be electrically spaced apart from the signal pin 110. The shield cans 120 and 130 may be formed of a metal material to shield electromagnetic waves. The shield cans 120 and 130 may include a lower shield can 120 and an upper shield can 130. The lower shield can 120 may include a seating groove 121 in which the lower portion of the cable 300 is seated. The upper shield can 130 may be formed to cover the lower shield can 120 and may have a seating groove 131 in which an upper portion of the cable 300 is seated. In the present embodiment, the shield cans 120 and 130 are described as being formed by combining the lower shield can 120 and the upper shield can 130, but the shield cans 120 and 130 may be integrally formed as a unitary structure.

The lower shield can 120 may include a shielding wall 122 that shields between adjacent signal pins 110. In addition, the upper shield can 130 may include a hole 132 into which an upper portion of the shielding wall 122 is inserted. According to an embodiment, the shielding wall that shields between adjacent signal pins 110 may be provided on the upper shield can 130 instead of the lower shield can 120.

The first insulating member 140 is coupled to the rear side of the signal pin 110, specifically, the second portion 112 of the signal pin 110, to insulate the signal pin 110 from the shield cans 120 and 130.

Figure 3A:
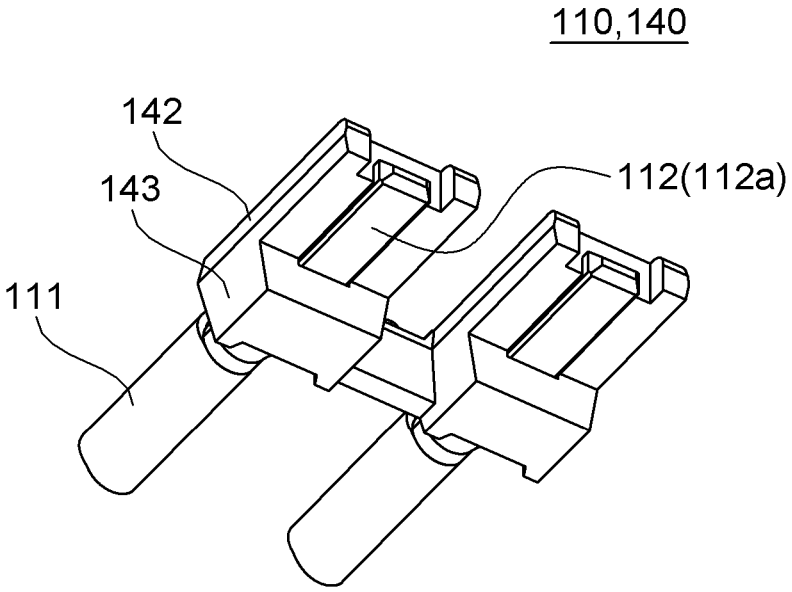
FIG. 3A is a perspective view of a signal pin and a first insulating member of a plug connector according to an embodiment of the present invention.
Figure 3B:
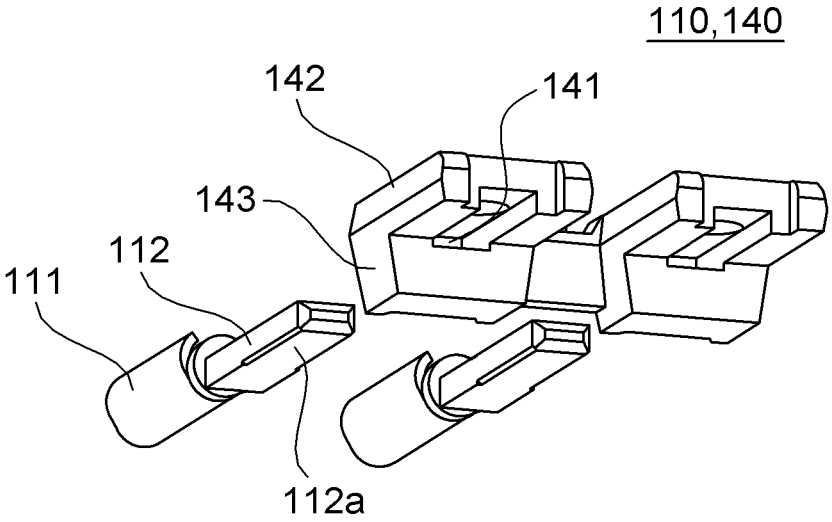
FIG. 3B is a view illustrating a state in which the signal pin and the first insulating member shown in FIG. 3A are separated from each other.
Figure 3C:
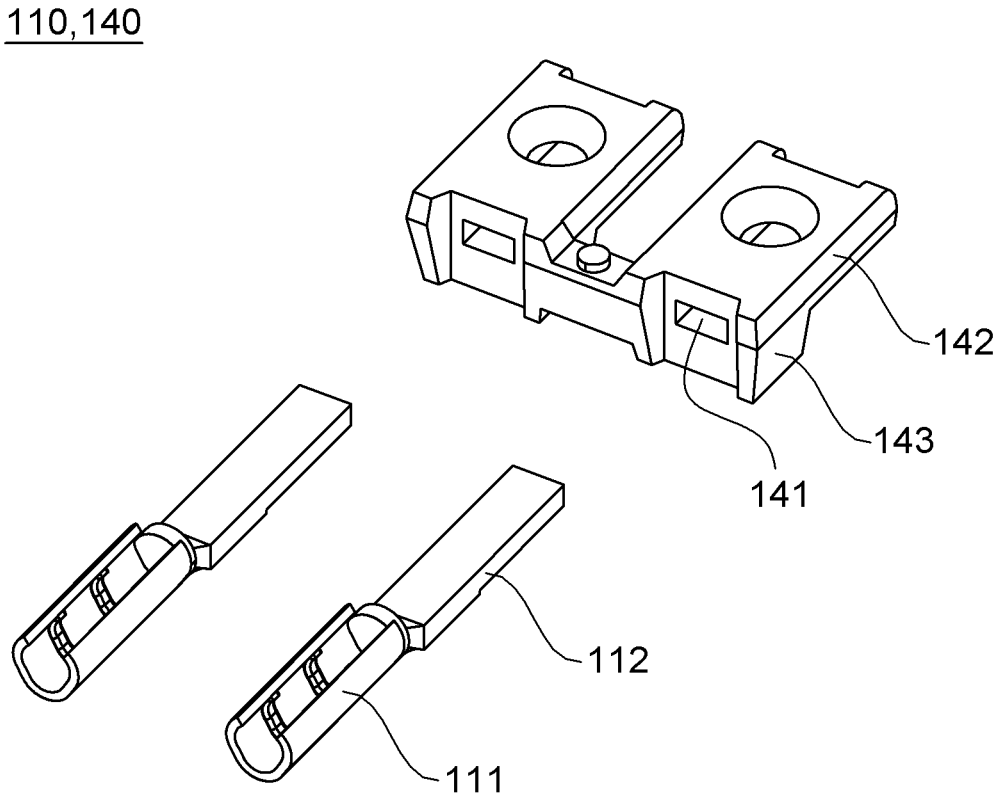
FIG. 3C is a view of the signal pin and the first insulating member shown in FIG. 3B, when viewed from a different side.

FIGS. 3A to 3C are views specifically illustrating the signal pins 110 and the first insulating member 140. FIG. 3A is a view of the signal pins 110 and the first insulating member 140, when viewed from the lower rear side, FIG. 3B is a view illustrating a state in which the signal pins 110 and the first insulating member 140 are separated from each other, and FIG. 3C is a view illustrating the signal pins 110 and the first insulating member 140 shown in FIG. 3B, when viewed from the upper front side.

The first insulating member 140 has a through hole 141 through which the second portion 112 of the signal pin 110 passes, and may consist of a first section 142 and a second section 143 that is integrally formed with the first section 142. The through hole 141, the first section 142, and the second section 143 are provided for each signal pin 110. The first section 142 forms an upper portion of the through hole 141 and may be elongated along a length direction of the second portion 112 such that it covers an upper portion of the second portion 112 of the signal pin 110 and exposes the lower surface 112*a* of the second portion 112. The second section 143 may form a lower portion of the through hole 141 and may be formed below the first section 142 to be shorter than the first section 142 along the length direction of the second portion 112 such that the lower surface 112*a* of the second portion 112 of the signal pin 110 is exposed.

The lower shield can 120 may have a seating groove 123 in which the second section 143 of the first insulating member 140 is seated. In addition, the upper shield can 130 may include a seating groove 133 in which the first section 142 of the first insulating member 140 is seated.

The plug shell 150 may surround the upper, lower, and both lateral surfaces of the shield cans 120 and 130 (specifically, the upper surface and both lateral surfaces of the upper shield can 130 and the lower surface and both lateral surfaces of the lower shield can 120) such that the lower surface 112*a* of the second portion 112 of the signal pin 110 is exposed.

The plug shell 150 may be formed of a metal material for shielding electromagnetic waves. Also, the plug shell 150 may include an enclosing portion that encloses and supports a part of the cable 300 exposed to the outside of the shield cans 120 and 130 in front of the shield cans 120 and 130. The enclosing portion 151 may extend in the front direction from the lower portion of the plug shell 150. The enclosing portion 151 may prevent damage due to excessive bending or separation of the cable 300.

According to the plug connector 100 in accordance with an embodiment of the present invention, electromagnetic waves generated through the signal line 310 and the outer conductor 330 of the cable 300 and the signal pin 110 are primarily shielded by the shield cans 120 and 130 and secondarily shielded by the plug shell 150, thus improving electromagnetic wave shielding performance. In addition, since electromagnetic waves between adjacent signal lines 310 or between adjacent signal pins 110 are shielded by the shielding walls 122 in the shield cans 120 and 130, interference between signals may be minimized.

Figure 4A:
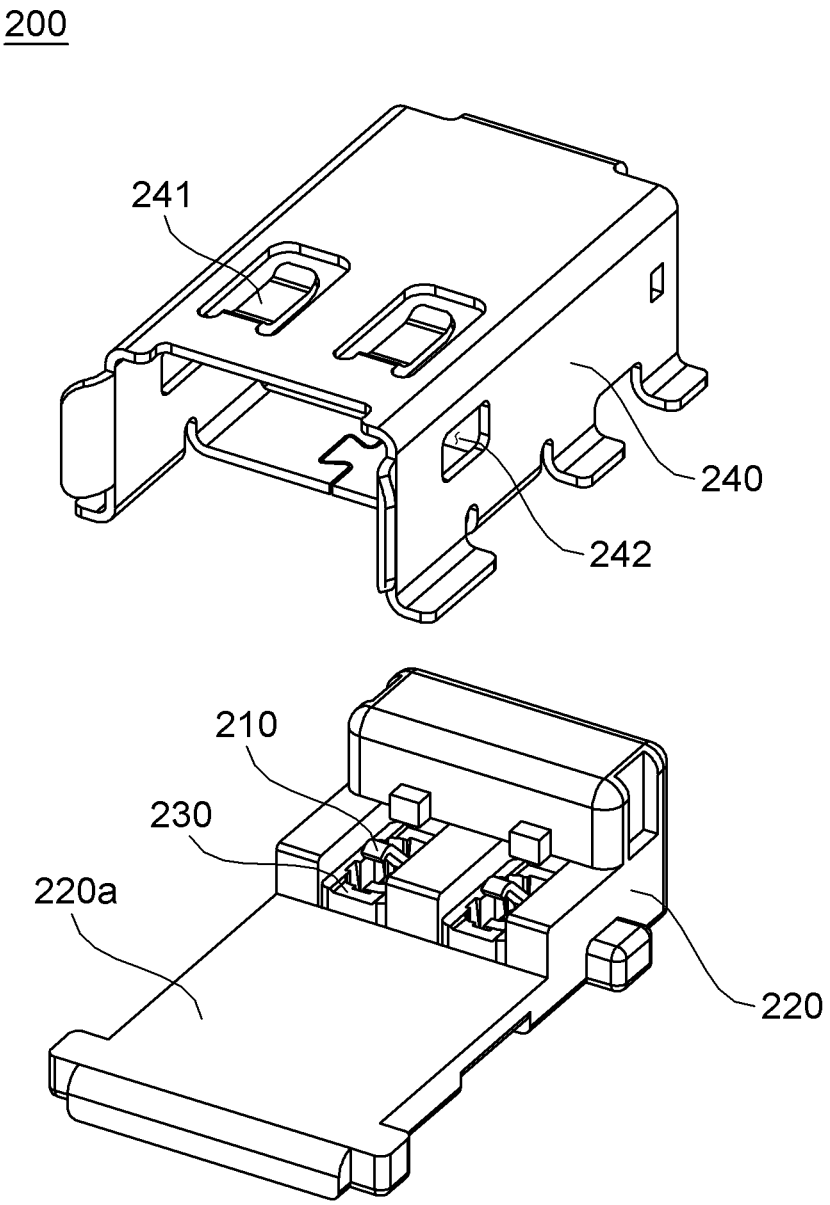
FIG. 4A is a first exploded view of a receptacle connector according to an embodiment of the present invention.
Figure 4B:
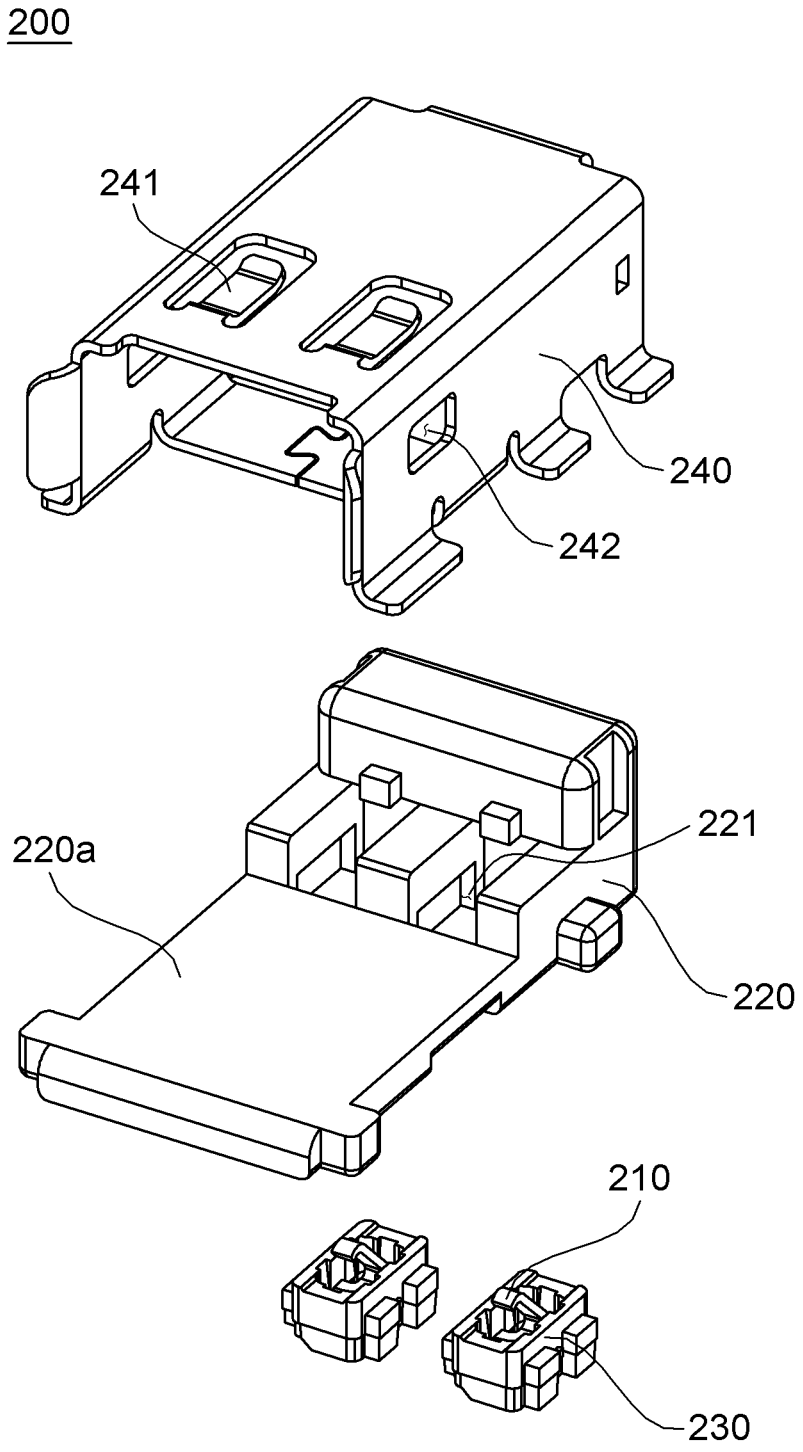
FIG. 4B is a second exploded view of a receptacle connector according to an embodiment of the present invention.
Figure 4C:
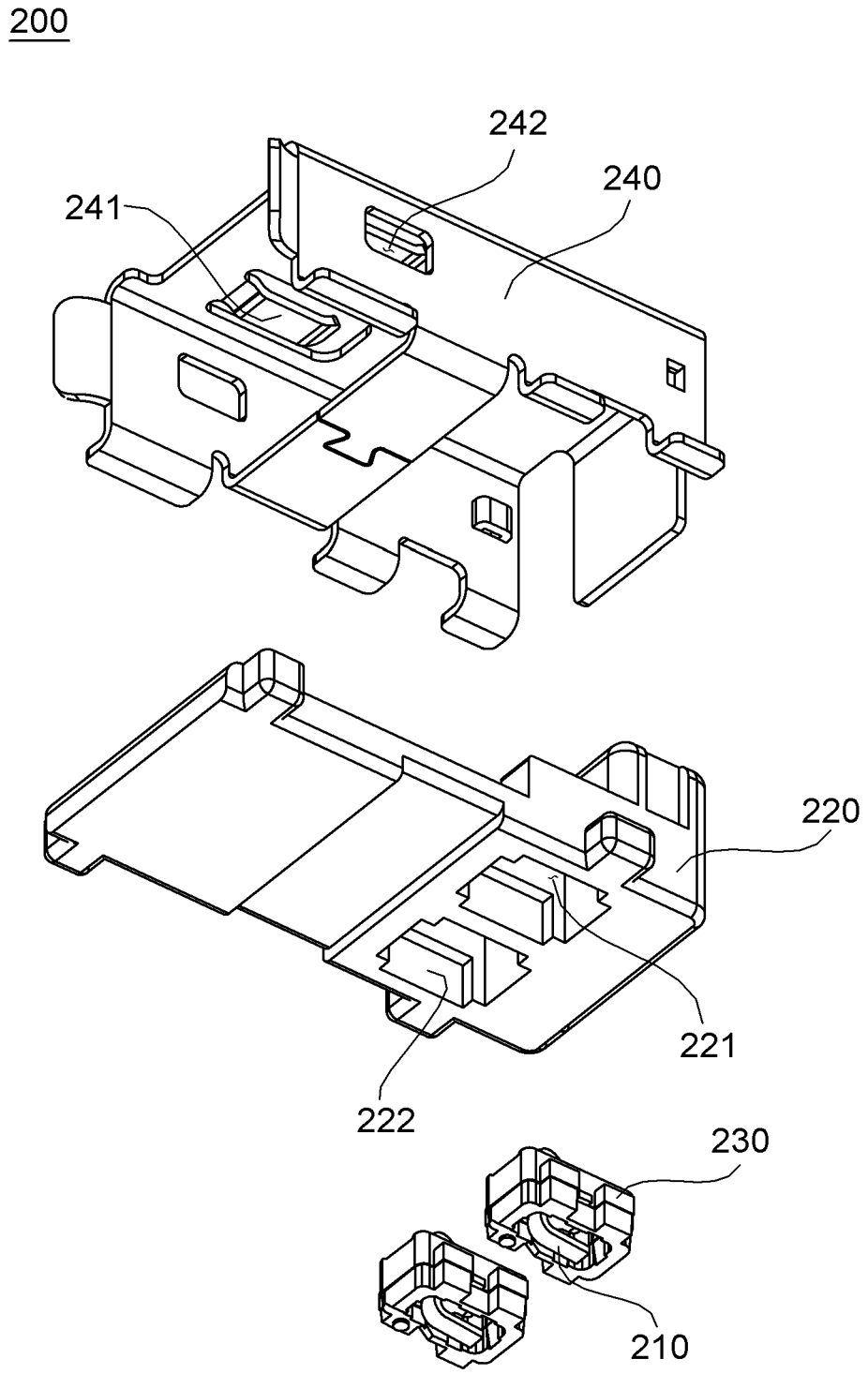
FIG. 4C is a view of the receptacle connector shown in FIG. 4B, when viewed from a different side.

FIGS. 4A to 4C are views of a receptacle connector 200 according to an embodiment of the present invention. FIG. 4A is a first exploded view of the receptacle connector 200 viewed from the upper front side thereof, FIG. 4B is a second exploded view of the receptacle connector 200 viewed from the upper front side thereof, and FIG. 4C is a view of the receptacle connector 200 shown in FIG. 4B when viewed from the lower front side.

The receptacle connector 200 includes a clip pin 210, a receptacle base 220, a second insulating member 230, and a receptacle shell 240.

The clip pin 210 may be formed such that a lower surface thereof is in electrical contact with a signal pad (not shown) of a circuit board (which is designated by reference P in FIG. 6*c*) through elastic contact or soldering and an upper portion thereof is in elastic contact with the lower surface 112*a* of the second portion 112 of the signal pin 110. According to an embodiment, the electrical contact of the clip pin 210 may be made by a surface mount method, such as SMD or SMT, a through-hole method, such as SIP, DIP, and QIP, or the like. When there are a plurality of signal pins 110, a plurality of clip pins 210 are also provided for each signal pin 110 and are arranged according to the arrangement of the signal pins 110.

The receptacle base 220 is installed on an upper surface of the substrate P, and provides a space 221 in which the second insulating member 230 and the clip pin 210 are accommodated. The space 221 may be formed to penetrate the top and bottom of the receptacle base 220.

The second insulating member 230 is inserted into the space 221 of the receptacle base 220 and surrounds the clip pin 210 from the side to fix the clip pin 210 and simultaneously insulate the clip pin 210 from the receptacle base 220.

The receptacle shell 240 covers the receptacle base 220 and provides a space in which the plug connector 100 is slidably inserted together with the receptacle base 220. That is, the plug connector 100 is slidably inserted into the space defined by an upper surface 220*a* of the receptacle base 220 and an inner upper surface and both inner lateral surfaces of the receptacle shell 240.

The receptacle base 220 and the receptacle shell 240 may be formed of a metal material to shield electromagnetic waves. In a state in which the plug connector 100 is coupled to the receptacle connector 200, electromagnetic waves generated through the signal line 310, the outer conductor 330, and the signal pin 110 are primarily shielded by the shield cans 120 and 130, secondarily shielded by the plug shell 150, and tertiarily shielded by the receptacle base 220 and the receptacle shell 240.

For a firm coupling between the plug connector 100 and the receptacle connector 200, the plug shell 150 may have a fastening hole 152 on the upper surface, and the receptacle shell 240 may have an elastic fastening portion 241 on the upper surface, which is inserted and fastened into the fastening hole 152. In addition, the receptacle shell 240 may include fastening holes 242 on both sides thereof, and the plug shell 150 may include fastening protrusions 153 on both sides thereof, which are inserted and fastened into the fastening holes 242. In addition, the plug shell 150 may have protrusions 154 on both sides thereof, and the projections 154 are in close contact with both inner sides of the receptacle shell 240. Also, the plug shell 150 has a plurality of protrusions 155 (for example, at four points on front, rear, and both sides) on a lower surface 150*a* thereof, and the protrusions 155 are in close contact with the upper surface 220*a* of the receptacle base 220.

Figure 5:
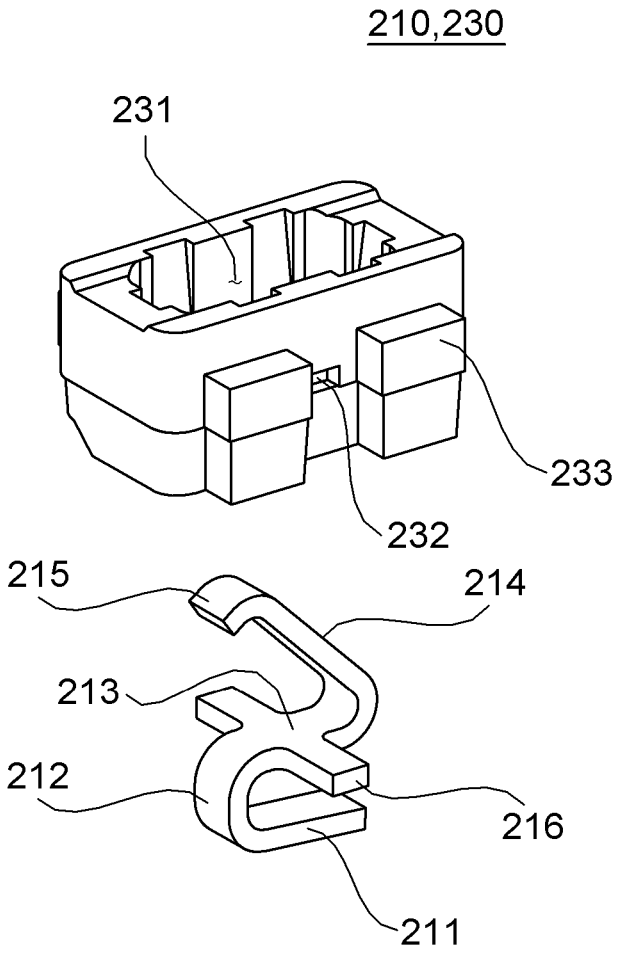
FIG. 5 is a view illustrating a state in which a clip pin and a second insulating member of a receptacle connector according to an embodiment of the present invention are separated from each other.

FIG. 5 is a view illustrating a state in which the clip pin 210 and the second insulating member 230 of the receptacle connector 200 are separated from each other.

The clip pin 210 may include a first section 211 having a lower surface in contact with the signal pad of the circuit board P, a second section 212 extending substantially upward from a front end of the first section 211, a third section 213 extending substantially rearward from an upper end of the second section 212, a fourth section 214 extending obliquely forward and upward from a rear end of the third section 213, and a fifth section 215 extending obliquely forward and downward from an upper end of the fourth section 214. A lower surface of the first section 211 may be in elastic contact with the signal pad of the circuit board P, and an upper portion of the clip pin 210, that is, a portion between the fourth section 214 and the fifth section 215, may be in elastic contact with the lower surface 112*a* of the second portion 112 of the signal pin 110. According to an embodiment, the electrical contact of the lower surface of the first section 211 of the clip pin 210 may be made by a surface mount method, such as SMD or SMT, a through-hole method, such as SIP, DIP, and QIP, or the like. In the present embodiment, the clip pin 210 is disposed so that the fifth section 215 faces forward, but the clip pin 210 may be disposed so that the fifth section 214 faces rearward.

The second insulating member 230 may have a through hole 231 penetrating vertically to accommodate the clip pin 210. In addition, the second insulating member 230 may have holes 232 on both sides, and the clip pin 210 may have protrusions 216 extending from the third section 213 on both sides. The protrusions 216 are inserted into the hole 232 to fix the clip pin 210 to the second insulating member 230. The second insulating member 230 may have protrusions 233 on both sides, and receiving grooves 222 to accommodate the protrusions 233 may be formed on both sides of the space 221 into which the second insulating member 230 of the receptacle base 220 is inserted.

Figure 6A:
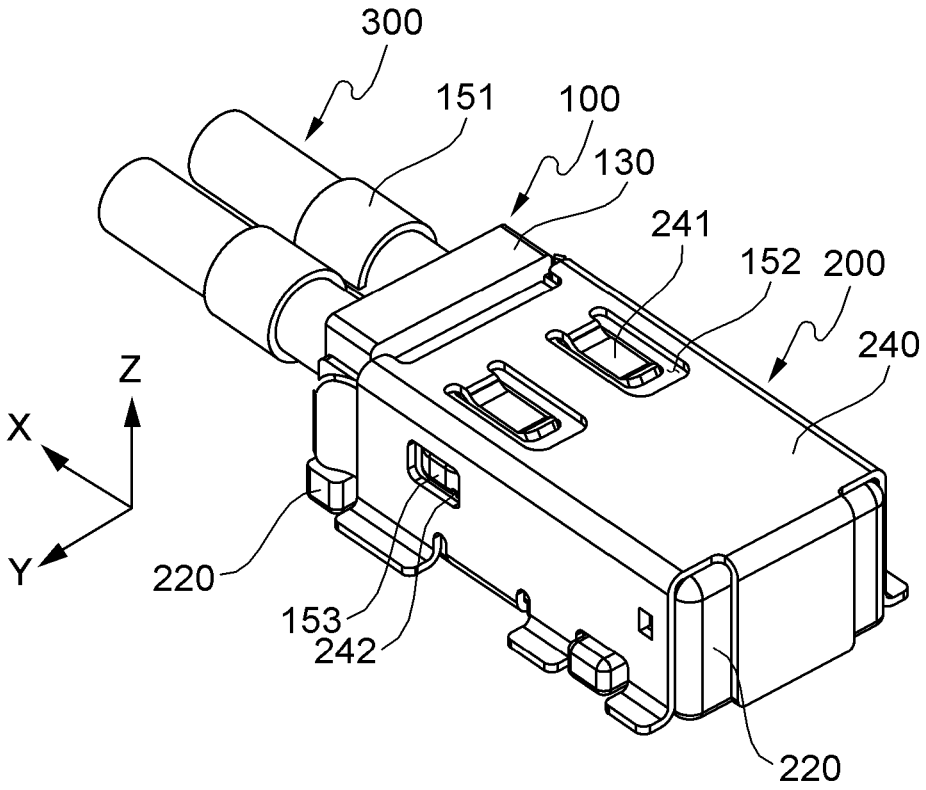
FIG. 6A is a view of a connector assembly in which a plug connector and a receptacle connector are coupled to each other, when viewed from one side.
Figure 6B:
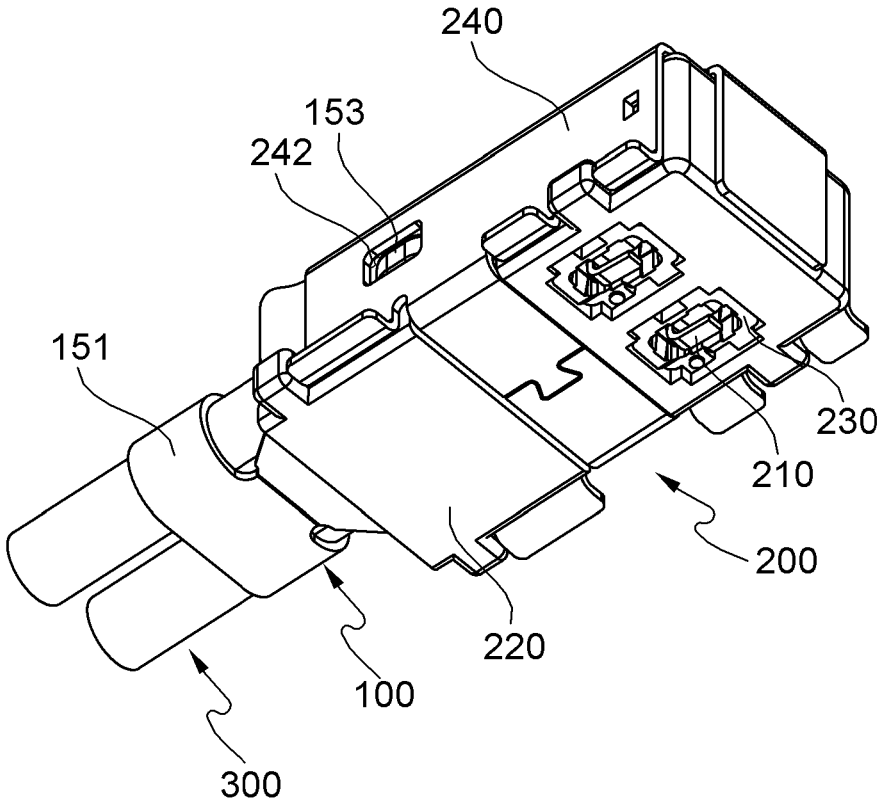
FIG. 6B is a view of the connector assembly shown in FIG. 6A, when viewed from a different side.
Figure 6C:
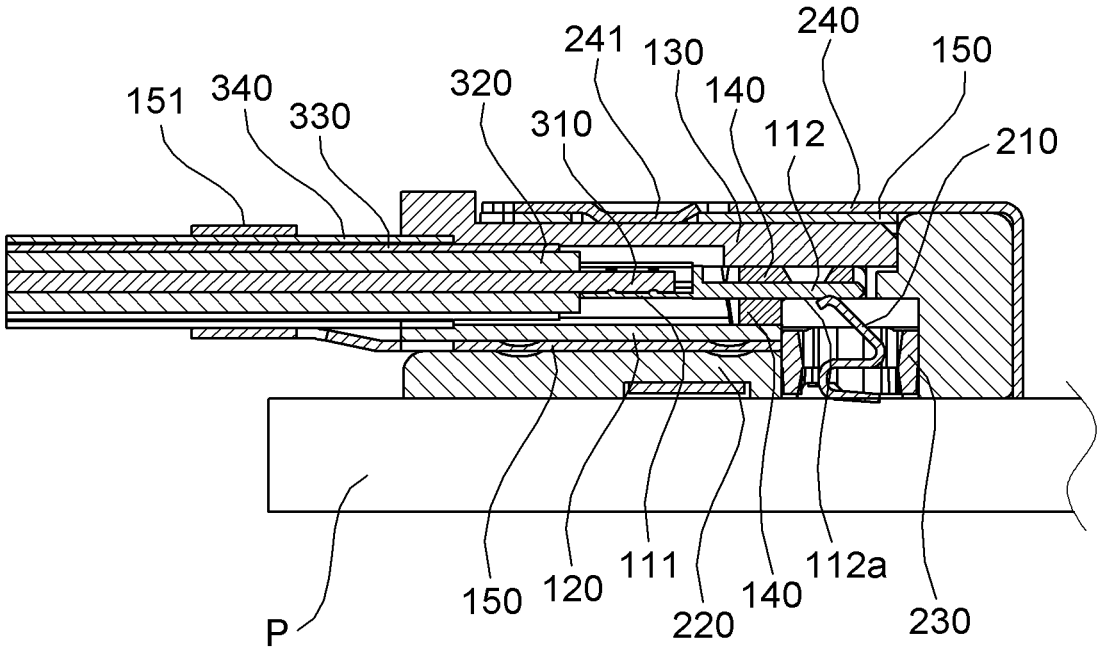
FIG. 6C is a cross-sectional view of a connector assembly in which a plug connector and a receptacle connector are coupled to each other.

FIGS. 6A to 6C are views of a connector assembly in which the plug connector 100 and the receptacle connector 200 are coupled to each other. FIG. 6A is a view of the connector assembly in which the plug connector 100 and the receptacle connector 200 are coupled to each other, when viewed from the upper rear side, FIG. 6B is a view of the connector assembly in which the plug connector 100 and the receptacle connector 200 are coupled to each other, when viewed from the lower rear side, and FIG. 6C is a cross-sectional view of the connector assembly in which the plug connector 100 and the receptacle connector 200 are coupled to each other.

Referring to FIG. 6C, the lower surface of the clip pin 210 is in electrical contact with the signal pad (not shown) of the circuit board P through elastic contact or soldering. The lower surface 112*a* of the second portion 112 of the signal pin 110 is in elastic contact with the upper portion of the clip pin 210. In addition, the signal line 310, the outer conductor 330, and the signal pin 110 are primarily shielded by the shield cans 120 and 130, secondary shielded by the plug shell 150, and tertiarily shielded by the receptacle base 220 and the receptacle shell 240.

Figure 7A:
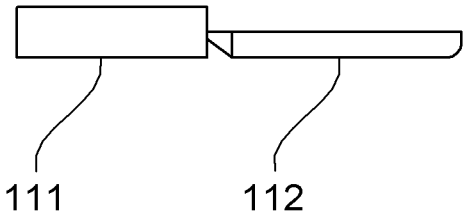
FIGS. 7A, 7B and 7C illustrate modifications of a signal pin.
Figure 7B:
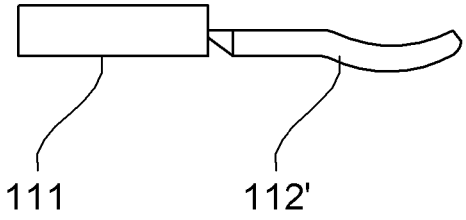
Figure 7C:
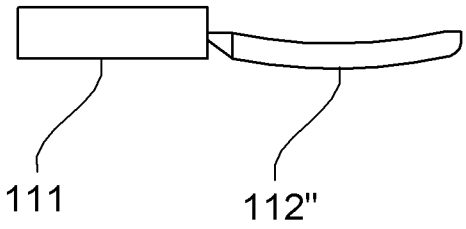

FIG. 7 illustrates modifications of the signal pin 110. The second portion of the signal pin 110 may be modified in various forms. For example, a second portion 112 of the signal pin 110 may be formed in a straight line, as shown in (a). Alternatively, a second portion 112' may be formed to be bent partially downward, as shown in (b), or a second portion 112" may be formed to be bent downward as a whole, as shown in (c).

Figure 8A:
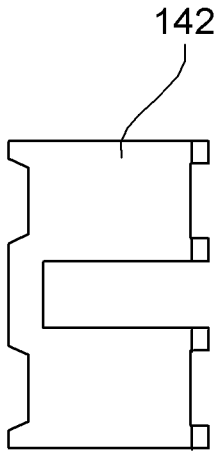
FIGS. 8A, 8B and 8C illustrate modifications of the first insulating member.
Figure 8B:
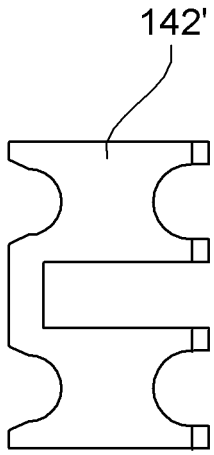
Figure 8C:
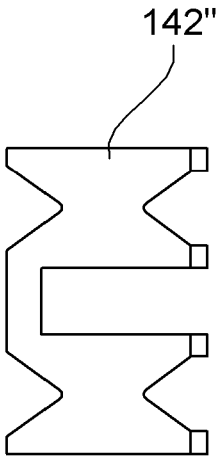

FIG. 8 illustrates modifications of the first insulating member 140. The first section of the first insulating member 140 may be modified in various forms. For example, a first section 142 of the first insulating member 140 may be formed in a generally rectangular shape when viewed from above, as shown in (a). Alternatively, a first section 142' may be formed such that the front and rear sides thereof are scooped as shown in (b), or a first section 142" may be formed such that the front and rear sides thereof are angularly recessed.

Figure 9:
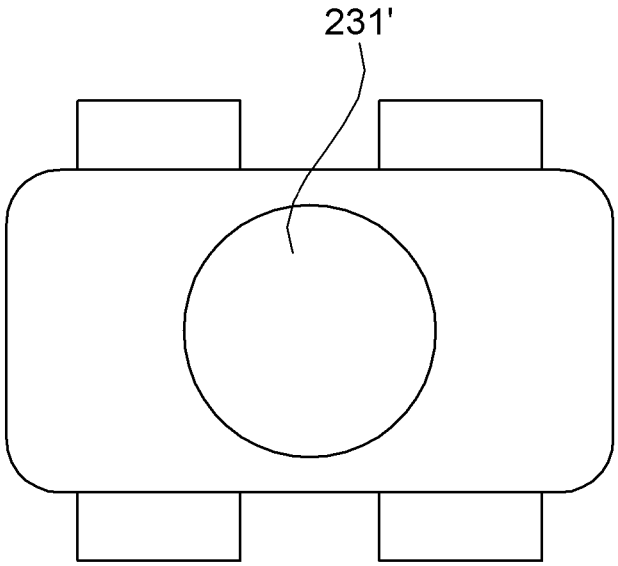
FIG. 9 illustrates a modification of the second insulating member.
Figure 10A:
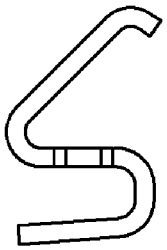
FIGS. 10A, 10B, 10C and 10D illustrate modifications of the clip pin.
Figure 10B:
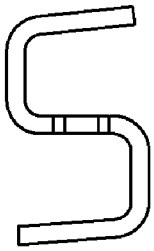
Figure 10C:
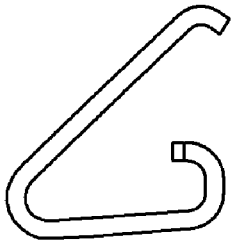
Figure 10D:
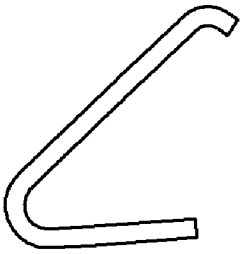

FIG. 9 illustrates a modification of the second insulating member 230. The through hole of the second insulating member 230 may be modified in various forms. For example, as shown in FIG. 5, the through hole 231 of the second insulating member 230 may have a generally rectangular shape, or a through hole 231' may have a circular shape as shown in FIG. 9.

FIG. 10 illustrates modifications of the clip pin 210. In the embodiment of the present invention, the shape of the clip 210 is not limited to the shape as shown in (a), such that the shape of the clip pin 210 may be modified in various forms, such as those shown in (b), (c), and (d), in which the lower surface of the clip pin 210 is in contact with the signal pad of the circuit board P and the upper portion of the clip pin 210 is in elastic contact with the lower surface 112*a* of the signal pin 110.

The plug connector according to the embodiment of the present invention has a structure that is slidably inserted into the receptacle connector, which allows the height of the connector assembly to be minimized and makes a fastening copper wire of the plug connector parallel to the circuit board, thereby advantageous in miniaturization of the connector assembly.

In addition, the plug connector according to the embodiment of the present invention has excellent electromagnetic wave shielding performance and is capable of simultaneously connecting a plurality of cables and a circuit board.

The effects of the present invention are not limited to those mentioned above, and unmentioned other effects may be clearly understood by those skilled in the art from the above descriptions.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A plug connector that is slidably inserted into a receptacle connector, comprising:

a signal pin having one side in electrical contact with one side of a signal line of a cable;

a shield can electrically spaced apart from the signal pin and surrounding the signal pin such that a lower surface of the other side of the signal pin is exposed;

a first insulating member coupled to the signal pin to insulate the signal pin and the shield can from each other; and a plug shell surrounding the shield can such that the lower surface of the other side of the signal pin is exposed, wherein the shield can comprises a lower shield can having a seating groove in which a lower portion of the cable is seated and an upper shield can having a seating groove in which an upper portion of the cable is seated and covering the lower shield can.

2. The plug connector of claim 1, wherein the signal pin comprises a first portion on one side thereof which has an insertion portion into which the signal line is inserted and a second portion on the other side thereof which is formed integrally with the first portion and has the lower surface of the other side of the signal pin.

3. The plug connector of claim 2, wherein the first insulating member has a through hole through which the second portion of the signal pin passes, and comprises a first section that forms an upper portion of the through hole and is formed to expose the lower surface of the other side of the second portion while covering an upper portion of the second portion; and a second section that forms a lower portion of the through hole and is formed below the first section to be shorter than the first section such that the lower surface of the other side of the second portion is exposed.

4. The plug connector of claim 1, wherein the plug shell is formed of a metal material.

5. The plug connector of claim 1, wherein the plug shell has an enclosing portion that encloses and supports a portion of the cable exposed to the outside of the shield can.

6. A plug connector that is slidably inserted into a receptacle connector, comprising:

a plurality of signal pins corresponding to a plurality of cables and including at least one signal pin having one side in electrical contact with one side of a signal line of one of the plurality of cables;

a shield can electrically spaced apart from the signal pin and surrounding the signal pin such that a lower surface of the other side of the signal pin is exposed;

a first insulating member coupled to the signal pin to insulate the signal pin and the shield can from each other; and a plug shell surrounding the shield can such that the lower surface of the other side of the signal pin is exposed, wherein the plurality of signal pins are arranged in parallel to each other and wherein the shield can comprises a shielding wall that shields between adjacent signal pins.

7. A plug connector that is slidably inserted into a receptacle connector, comprising:

a signal pin having one side in electrical contact with one side of a signal line of a cable;

a shield can electrically spaced apart from the signal pin and surrounding the signal pin such that a lower surface of the other side of the signal pin is exposed;

a first insulating member coupled to the signal pin to insulate the signal pin and the shield can from each other; and a plug shell surrounding the shield can such that the lower surface of the other side of the signal pin is exposed, wherein the signal pin comprises a first portion on one side thereof which has an insertion portion into which the signal line is inserted and a second portion on the other side thereof which is formed integrally with the first portion and has the lower surface of the other side of the signal pin, wherein the first insulating member has a through hole through which the second portion of the signal pin passes, and comprises a first section that forms an upper portion of the through hole and is formed to expose the lower surface of the other side of the second portion while covering an upper portion of the second portion; and a second section that forms a lower portion of the through hole and is formed below the first section to be shorter than the first section such that the lower surface of the other side of the second portion is exposed, and wherein the shield can comprises: a lower shield can having a seating groove in which a lower portion of the cable is seated and a seating groove in which the second section of the first insulating member is seated; and an upper shield can covering the lower shield can and having a seating groove in which an upper portion of the cable is seated and a seating groove in which the first section of the first insulating member is seated.

* * * * *